US007324063B2

(12) United States Patent
Bae et al.

(10) Patent No.: US 7,324,063 B2
(45) Date of Patent: Jan. 29, 2008

(54) RECTANGULAR HELICAL ANTENNA

(75) Inventors: Seok Bae, Kyungki-do (KR); Jae Suk Sung, Kyungki-do (KR); Mano Yasuhiko, Kyungki-do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 11/433,676

(22) Filed: May 15, 2006

(65) Prior Publication Data

US 2006/0256031 A1 Nov. 16, 2006

(30) Foreign Application Priority Data

May 16, 2005 (KR) ..... 10-2005-0040875

(51) Int. Cl.
*H01Q 1/36* (2006.01)

(52) U.S. Cl. ..... 343/895; 343/787

(58) Field of Classification Search ..... 343/787, 343/895

See application file for complete search history.

(56) References Cited

U.S. PATENT DOCUMENTS 5,977,927 A * 11/1999 Mandai et al. ..... 343/788
6,486,852 B1 * 11/2002 Hirose et al. ..... 343/895
6,674,405 B2 * 1/2004 Wang ..... 343/700 MS
2004/0119647 A1 * 6/2004 Harihara ..... 343/700 MS

FOREIGN PATENT DOCUMENTS

KR 1995-31988 A 12/1995
KR 1998-70284 10/1998
KR 10-2001-25172 A 4/2001

OTHER PUBLICATIONS

Korean Intellectual Property Office, Office Action mailed, Sep. 18, 2006.

* cited by examiner

*Primary Examiner*—Tho Phan
(74) *Attorney, Agent, or Firm*—Lowe Hauptman Ham & Berner

(57) ABSTRACT

In a helical antenna to be installed inside a mobile communication terminal, for processing low-bandwidth signals, a substrate is made of magnetic dielectric material, a plurality of lower electrodes are disposed on the underside of the substrate, and a plurality of upper electrodes are disposed on the top of the substrate. The upper electrodes are inclined with respect to the lower electrodes, respectively, at a predetermined angle. A plurality of side electrodes electrically connect the lower electrodes with the upper electrodes, respectively. At least a part of a magnetic moment vector, which is formed around each of the lower electrodes by a current flowing in the each lower electrode, is directed in parallel with a current flowing in each of the upper electrodes corresponding to the each lower electrode.

9 Claims, 11 Drawing Sheets

RECTANGULAR HELICAL ANTENNA

RELATED APPLICATION

The present application is based on and claims priority from Korean Application Number 10-2005-0040875, filed May 16, 2005, the disclosure of which is hereby incorporated by reference herein in its entirety.

BACKGROUND OF THE INVENTION

1. Field of the Invention

The present invention relates to an antenna provided in a mobile communication terminal to transmit/receive radio signals, and more particularly, to a helical antenna installed inside a mobile communication terminal, capable of processing low-bandwidth signals.

2. Description of the Related Art

Recent trend of installing more wireless technologies in a single mobile communication terminal leads to the diversification of frequency bandwidth used by an antenna of the terminal. Particularly, frequency bandwidths currently used in a mobile communication terminal include 800 MHz to 2 GHz (for mobile phones), 2.4 GHZ to 5 GHz (for wireless LAN), 88 MHz to 108 MHz (for FM radio), 470 MHz to 770 MHz (for TV) and other bandwidths for ultra wideband (UWB), Zigbee, Digital Multimedia Broadcasting (DMB) and soon. The DMB bandwidth is divided into 2630 MHz to 2655 MHz for satellite DMB and 180 MHz to 210 MHz for terrestrial DMB.

Currently, mobile communication terminals confront demands for various service functions as well as size and weight reduction. In order to meet such demands, a mobile communication terminal tends to adopt an antenna and other components which are more compact-sized and well as multi-functional. Moreover, recent trend is that more mobile communication terminals are internally equipped with an antenna. Accordingly, an antenna to be installed inside a mobile communication terminal has to satisfy desired performance as well as occupy only a very small volume inside the terminal.

FIG. 1 is a structural diagram illustrating a general built-in Planar Inverted F Antenna (PIFA).

The PIFA is an antenna designed for installation in a mobile communication terminal. As shown in FIG. 1, the PIFA generally includes a planar radiator 2, a ground line 4 and a feeding line 5 connected with the radiator 2, and a ground plate 9. The radiator 2 is powered via the feeding line 5, and forms an impedance matching with the ground plate 9 by means of the ground line 4. In the PIFA, the width Wp of the ground line 4 and the width W of the radiator 2 should be considered in designing of the length L of the radiator and the height H of the antenna.

The PIFA has directivity. That is, when current induction to the radiator 2 generates beams, a beam flux directed toward the ground surface is re-induced to attenuate another beam flux directed toward the human body, thereby improving SAR characteristics as well as enhancing beam intensity induced to the radiator. The PIFA operates as a rectangular micro-strip antenna, in which the length of a rectangular panel-shaped radiator is reduced by half, thereby realizing a low profile structure. Furthermore, the PIFA is provided as a built-in antenna installed inside a terminal, thereby obtaining excellent endurance against external impact as well as allowing the terminal to be designed with an aesthetic appearance.

FIGS. 2 and 2*a* are perspective views illustrating a conventional built-in helical antenna.

Referring to FIGS. 2 and 2*a*, a conventional helical antenna 20 includes a feeding line 22, a ground line 23 and a helical radiator 24 formed on a dielectric substrate 21.

The feeding line 22 and the ground line 23 are formed on the underside of the dielectric substrate 21, and connected to the radiator 24. The radiator 24 includes a plurality of lower electrodes 25 formed on the underside of the substrate 21, arranged in parallel with the feeding line 22 and the ground line 23. The radiator 24 also includes a plurality of upper electrodes 26 formed on the top of the substrate 21, inclined with respect to the lower electrode 25. Each lower electrode 25 is connected at the lower end thereof with the lower end of each upper electrode 26 by means of a via 27 made of conductive paste filled into a via hole. The lower electrode 25 is connected at the upper end thereof with the upper end of an adjacent upper electrode 26 by means of a side electrode 27-1, and then with another lower electrode 25-1, thereby producing a helical antenna.

FIG. 3 is a graph illustrating resonant frequency characteristics of the helical antenna shown in FIG. 2.

FIG. 3 shows an operation frequency of an helical antenna in which a substrate 21 with a length of 20 mm, a width of 4 mm and a thickness of 1 mm was used, and the total length of the radiator 24 was 14.6 cm with 21 turns. In the graph, the horizontal axis indicates frequency (GHz) and the vertical axis indicates S11 parameter (dB). Referring to FIG. 3, it can be experimentally understood that the conventional helical antenna 20 has a resonance region 30 in vicinity of 570 MHz with radiation efficiency of 41.90%.

The conventional built-in antennas as shown in FIGS. 2 to 3 can be fabricated to have a size of about 10 mm×10 mm in a frequency bandwidth of 1 GHz or more. However, in case of a mobile communication terminal for terrestrial DMB where frequency to be processed by an antenna drops to a bandwidth of several hundred MHz or less, the antenna is required to have a length (i.e., $1/\lambda$, $\frac{1}{2}\lambda$ or $\frac{1}{4}\lambda$, where $\lambda$ is a wavelength of a radio-wave) that is merely several ten centimeter. Thus, conventional built-in antennas cannot process lower bandwidth frequencies of for example terrestrial DMB. Furthermore, the size of an antenna to be installed inside a mobile communication terminal such as a portable phone is limited to 5 cm or less. However, an antenna fabricated according to a conventional built-in antenna technology is sized of several ten cm or more, and thus lacks applicability as a built-in antenna.

SUMMARY OF THE INVENTION

The present invention has been made to solve the foregoing problems of the prior art and it is therefore an object of the present invention to provide an antenna which can be easily fabricated with a very small size to be installed inside a mobile communication terminal for terrestrial DMB.

According to an aspect of the invention for realizing the object, the invention provides a rectangular helical antenna comprising: a substrate made of magnetic dielectric material; a plurality of lower electrodes disposed on the underside of the substrate; a plurality of upper electrodes disposed on the top of the substrate, the upper electrodes inclined with respect to the lower electrodes, respectively, at a predetermined angle; and a plurality of side electrodes for electrically connecting the lower electrodes with the upper electrodes, respectively, whereby at least a part of magnetic moment vector, which is formed around each of the lower electrodes by current flowing along the each lower electrode, is directed in parallel with current flowing along each of the upper electrodes corresponding to the each lower electrode.

Preferably, the substrate is made of ferrite or ferrite-resin composite.

The angle preferably ranges from 80° to 100°, and more preferably, is 90°.

Preferably, each of the lower and upper electrodes is wedge-shaped, and each of the upper electrodes has a bent portion in a central area thereof.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

The present invention will now be described more fully hereinafter with reference to the accompanying drawings, in which preferred embodiments of the invention are shown. It should be construed that the same reference numbers and signs are used to designate the same or similar components throughout the accompanying drawings. In the following description of the invention, well-known functions or constructions will not be described in detail as they would unnecessarily obscure the understanding/concept of the invention.

Figure 1:
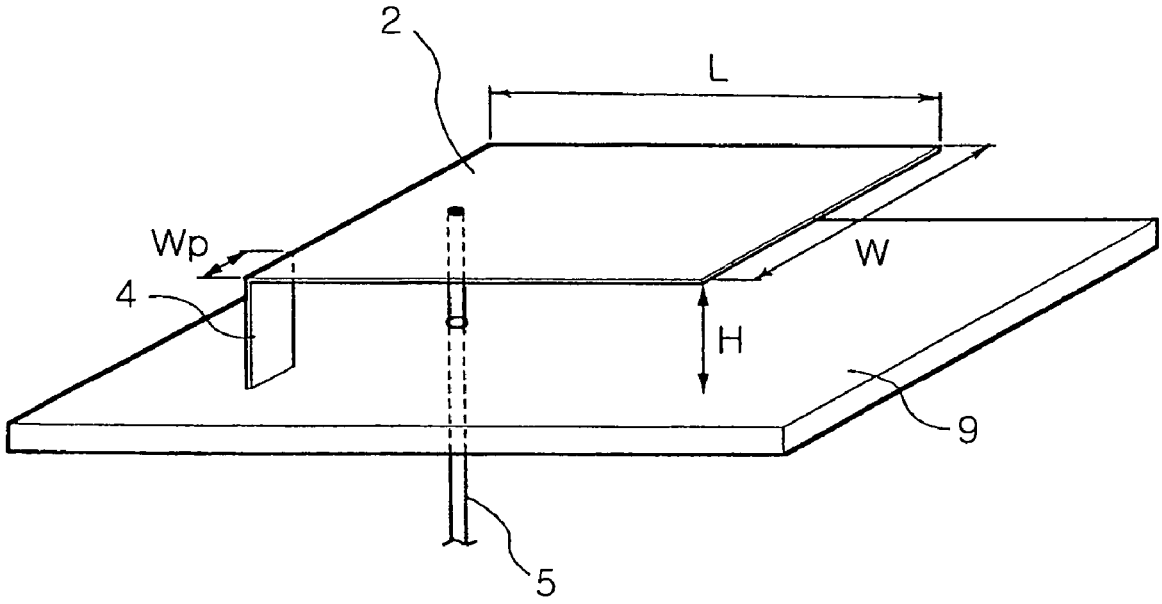
Prior art FIG. 1
FIG. 1 is a perspective view illustrating a general PIFA antenna.
Figure 2:
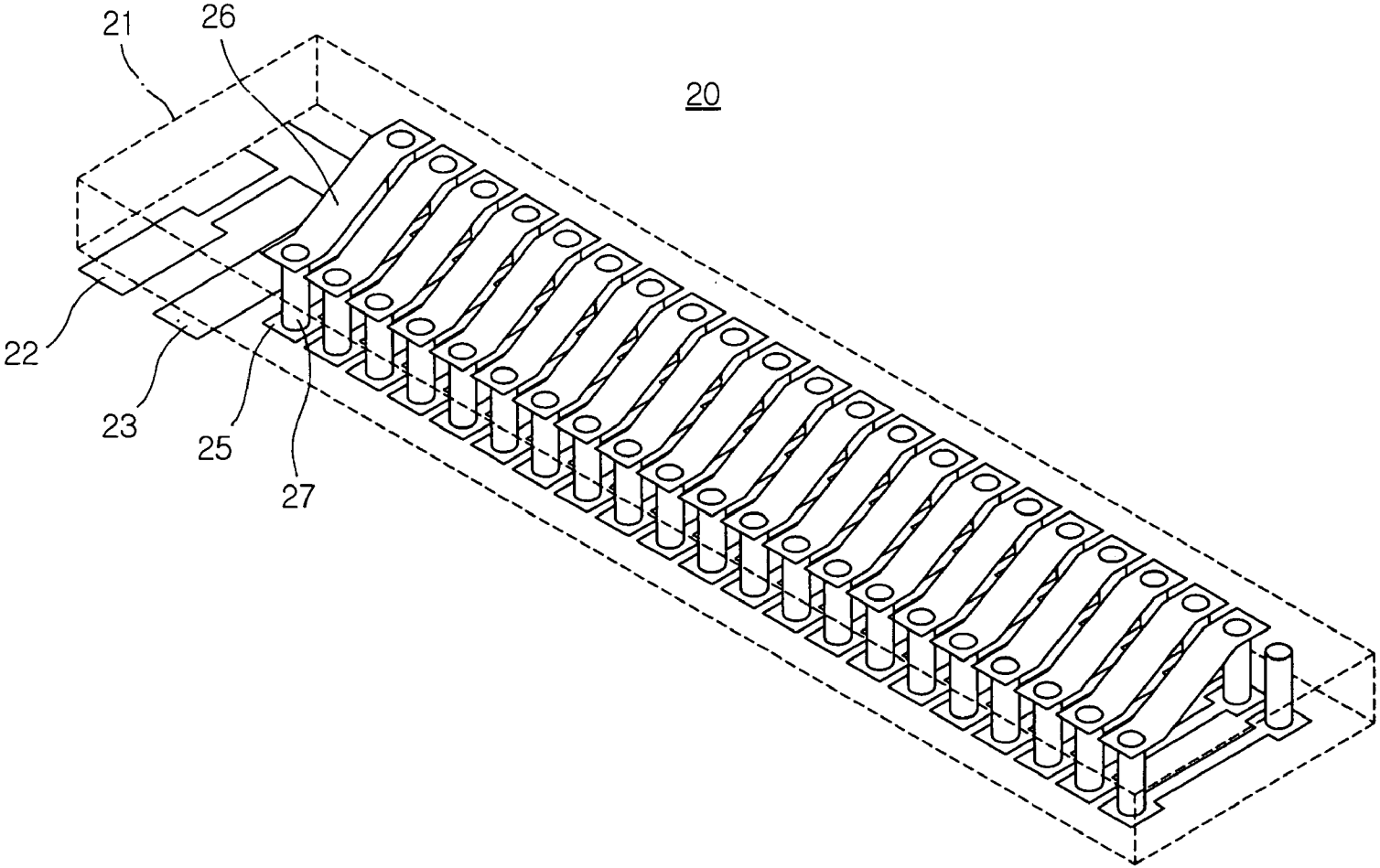
Prior art FIG. 2
FIGS. 2 and 2*a* are perspective views illustrating a conventional built-in helical antenna.
Figure 2A:
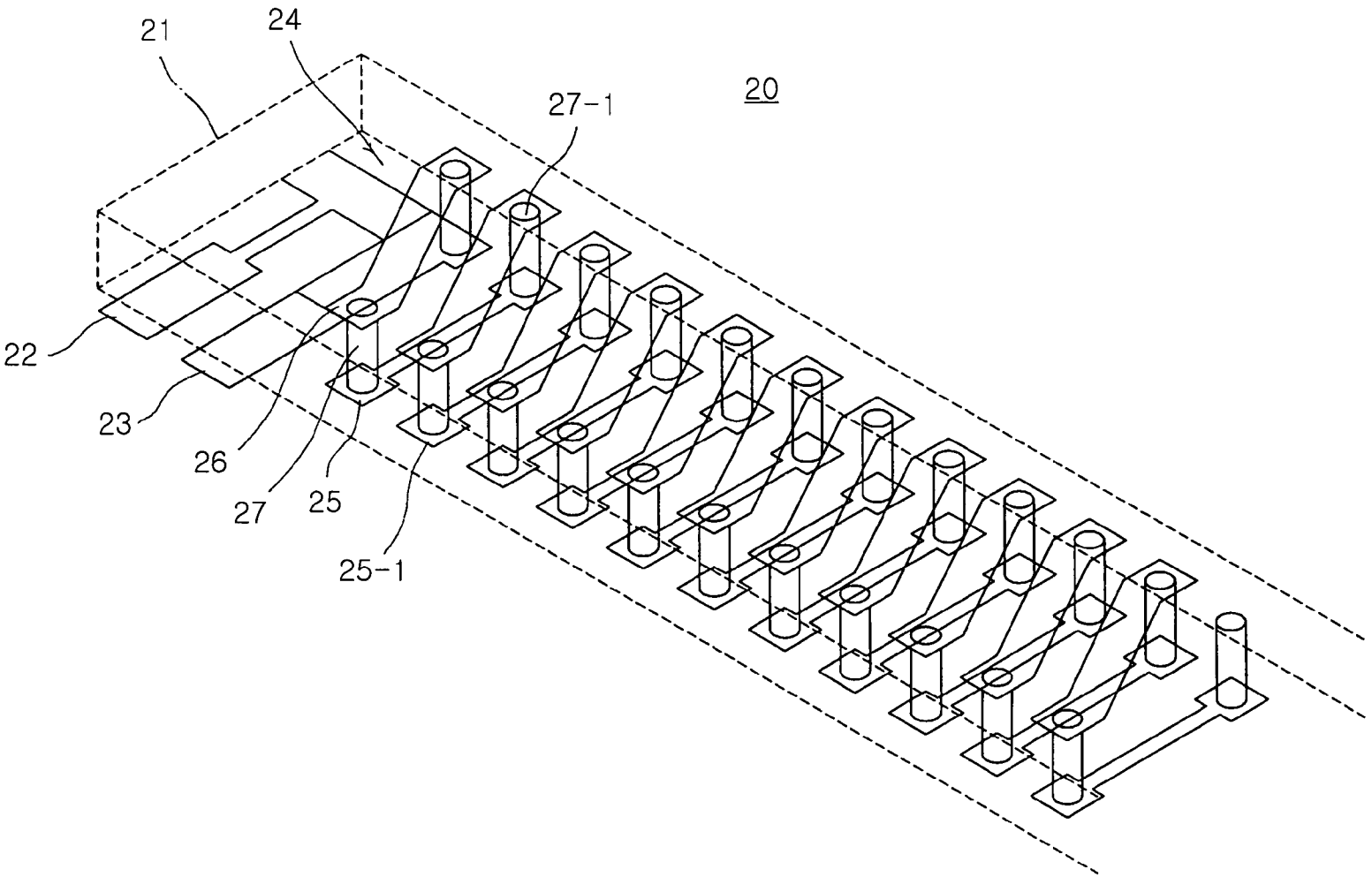
Prior art FIG. 2a
Figure 3:
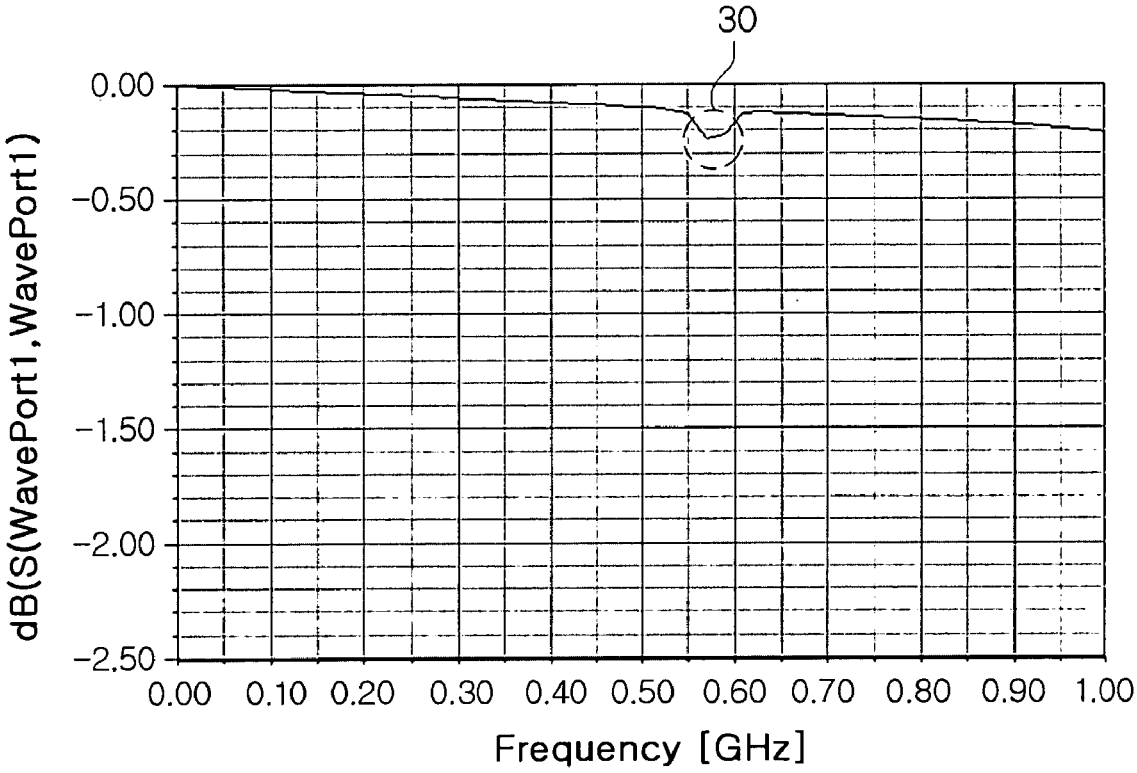
Prior art FIG. 3
FIG. 3 is a graph illustrating resonant frequency characteristics of the helical antenna shown in FIG. 2.
Figure 4:
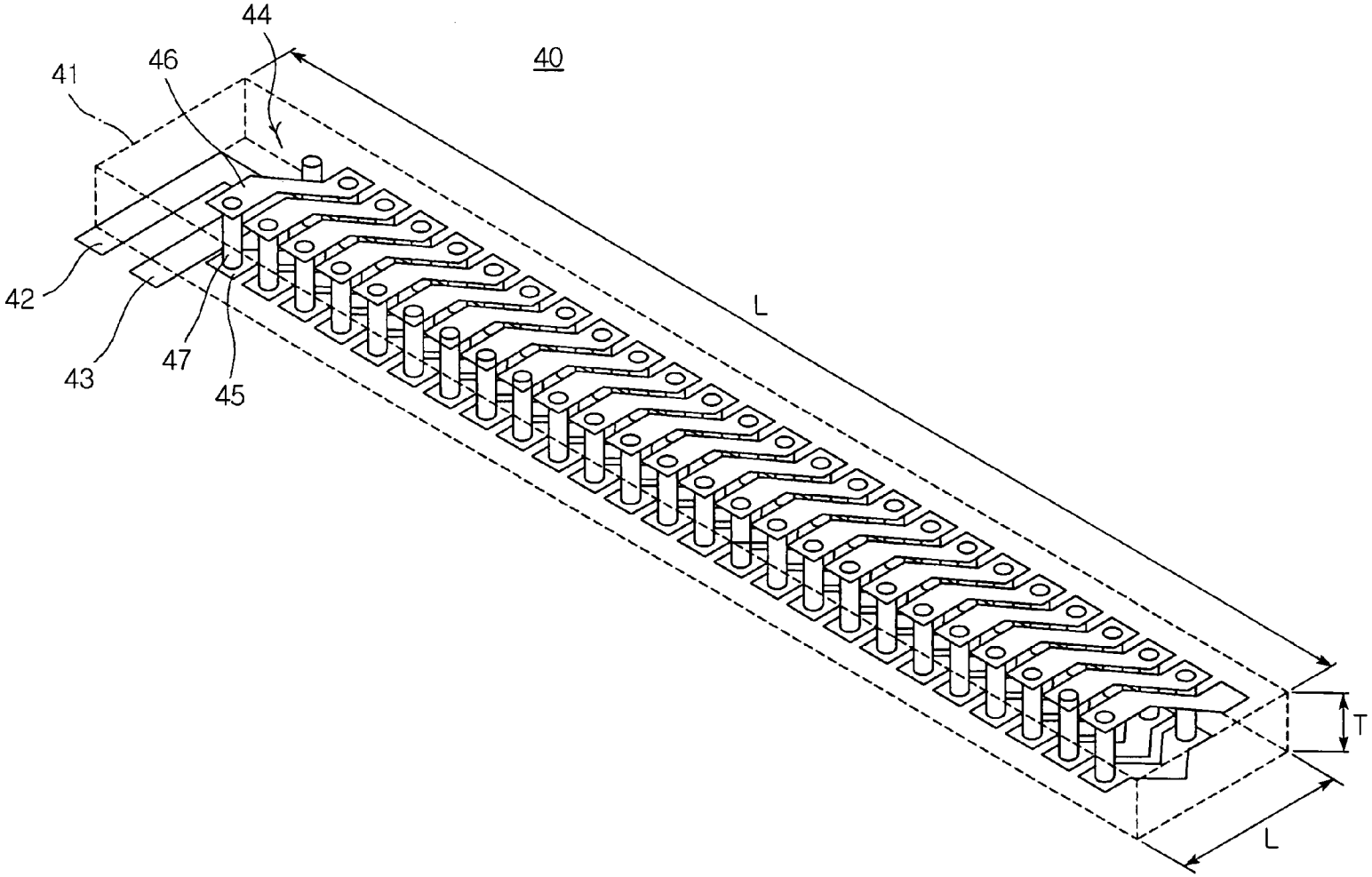
FIGS. 4 and 4*a* are perspective views illustrating a rectangular helical antenna according to an embodiment of the invention.
Figure 4A:
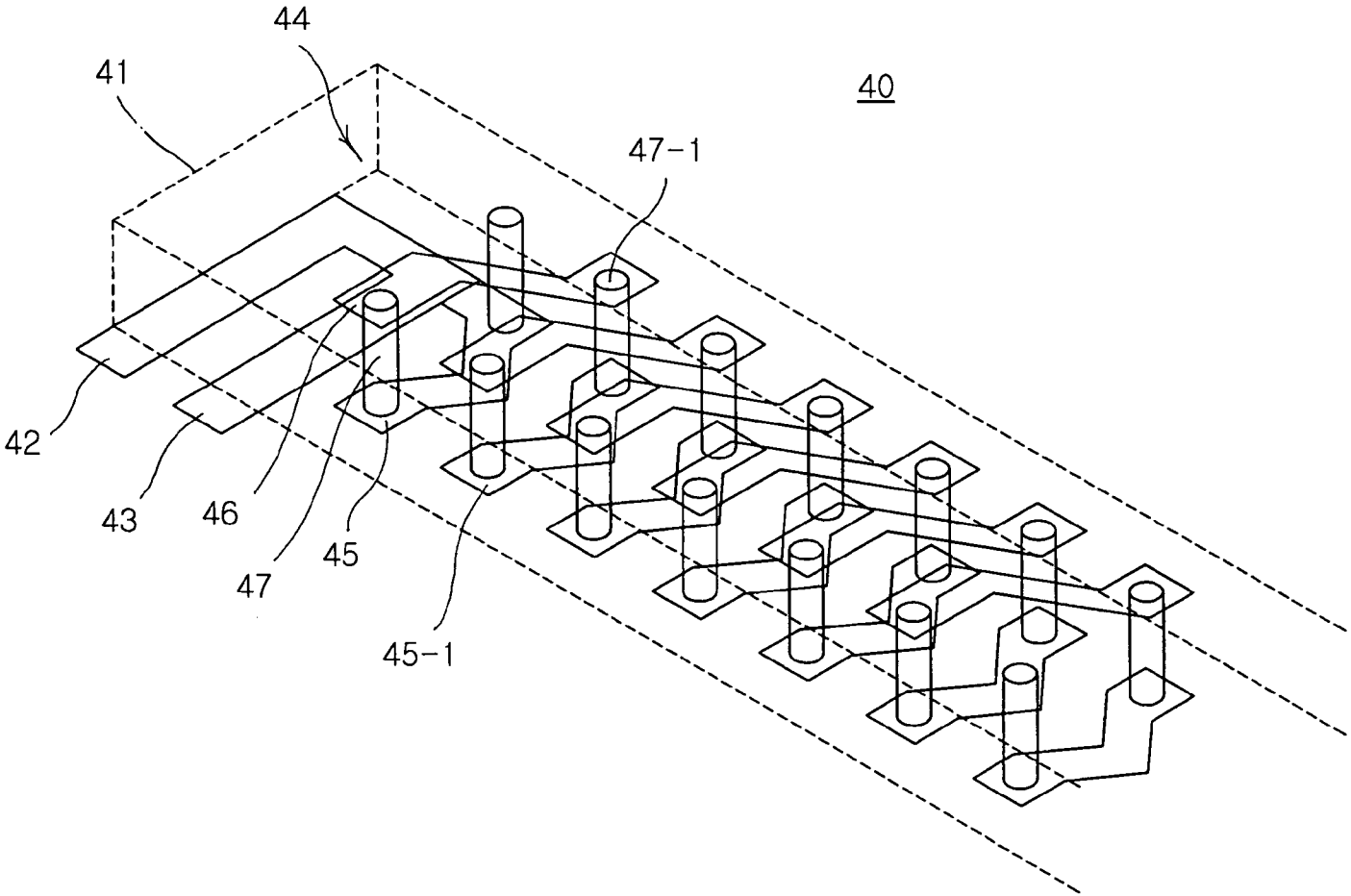

FIGS. 4 and 4*a* are perspective views illustrating a rectangular helical antenna according to an embodiment of the invention.

Referring to FIGS. 4 and 4*a*, a rectangular helical antenna 40 according to an embodiment of the invention includes a substrate 41 having a magnetic property, a feeding part 42, a ground part 43 and a radiator 44.

The substrate 41 preferably has a substantially rectangular parallelpiped configuration, and is made of a magnetic dielectric material such as ferrite or ferrite-resin composite having magnetic and dielectric properties according to the following reasons.

Resonant length acting as a critical factor in miniaturization of an antenna is related with Equation 1 below:

$$\frac{\lambda}{\lambda_0} = \frac{1}{\sqrt{\varepsilon \times \mu}}, \qquad \text{Equation 1}$$

where λ is an actual wavelength of an antenna, λ0 is a wavelength in a free space, ∈ is a dielectric constant, μ is a magnetic permeability.

Conventionally, antennas have been made of glass ceramics having a dielectric constant ∈ of 4 to 7. However, as can be seen from Equation 1 above, raised electric constant may reduce resonant length thereby to shorten the length of an antenna, but narrows available bandwidth of the antenna. So, the dielectric constant cannot be raised limitlessly. On the contrary, magnetic material rarely has an effect to the bandwidth even if its magnetic permeability is raised. Accordingly, a material having a dielectric constant ∈ and a magnetic permeability μ, when used for an antenna substrate, can further reduce the resonant length of an antenna compared to a typical antenna material of a high dielectric constant (magnetic permeability=1). This as a result reduces the length of an antenna wire, which in turn can realize further miniaturization of the antenna.

According to the invention, a ferrite-resin composite having a magnetic permeability μ of 2 to 100 and a dielectric constant ∈ of 2 to 100, when used for the substrate 41, achieves larger wavelength reduction than glass ceramics having a dielectric constant of 4 to 7, thereby facilitating further miniaturization of the antenna. Furthermore, the substrate 41 of the invention may be made of ferrite having both of dielectric and magnetic properties.

The feeding part 42 is formed at one end of the substrate 41 on the underside thereof, and connected with a circuit (not shown) of a mobile communication terminal to be powered therefrom.

The ground part 43 is formed on the underside of the substrate 41, adjacent to and in parallel with the feeding part. The ground part 43 is connected with a ground part (not shown) of the mobile communication terminal to ground the antenna. The embodiment shown in FIG. 4 discloses a PIFA. Alternatively, the rectangular helical antenna 40 may be used in the form of a monopole antenna where the ground part 43 is not installed, which is also embraced within the scope of the invention.

The radiator 44 includes a plurality of lower electrodes 45, a plurality of upper electrodes 46 and a plurality of side electrodes 47. In case that the substrate 41 is made of magnetic dielectric material according to the invention, the lower electrodes 45 of the radiator 44 are spaced from the upper electrodes 46 in the thickness direction T of the substrate 41. The lower electrodes 45 intersect or are inclined with respect to the upper electrodes 46 at a predetermined angle.

The lower electrodes 45 are formed on the underside of the substrate 41, and connected with the feeding part 42 and the ground part 43. The lower electrodes 45 each are formed as a wedge-shaped conductor line that is bent in a central area. The lower electrodes 45 have an equally shaped, repeated pattern, and are spaced from each other in the longitudinal direction L of the substrate 41.

The upper electrodes 46 are formed on the top of the substrate 41. The upper electrodes 46 are spaced from the lower electrodes 45 in the thickness direction of the substrate, and arranged to overlap the same at a predetermined angle. The upper electrodes 46 each may have a bent portion 48 in a central area to provide a structure in which the upper electrodes 46 are overlapped above the lower electrodes 45. Each upper electrode 46 is connected at the lower end thereof with the lower end of each lower end 44 via each side electrode 47 and the upper electrode 46 is connected at the upper end thereof with the upper end of an adjacent lower electrode 45-1 by another side electrode 47-1, thereby producing a helical antenna structure. Furthermore, the helical antenna 40 shows a radiation pattern with its intensity predominant in sharp areas such as the bent portions 48. As a result, the bent portions 48 serve to enhance the radiation efficiency of the antenna 40 of the invention.

The side electrodes 47 electrically connect the lower electrodes 45 with the upper electrodes 46. The side electrodes 47 are composed of vias formed in the substrate 41, which are optionally filled with conductive paste. Furthermore, the side electrodes 47 may be formed of conductor integrally with the lower and upper electrodes 45 and 46.

Figure 5:
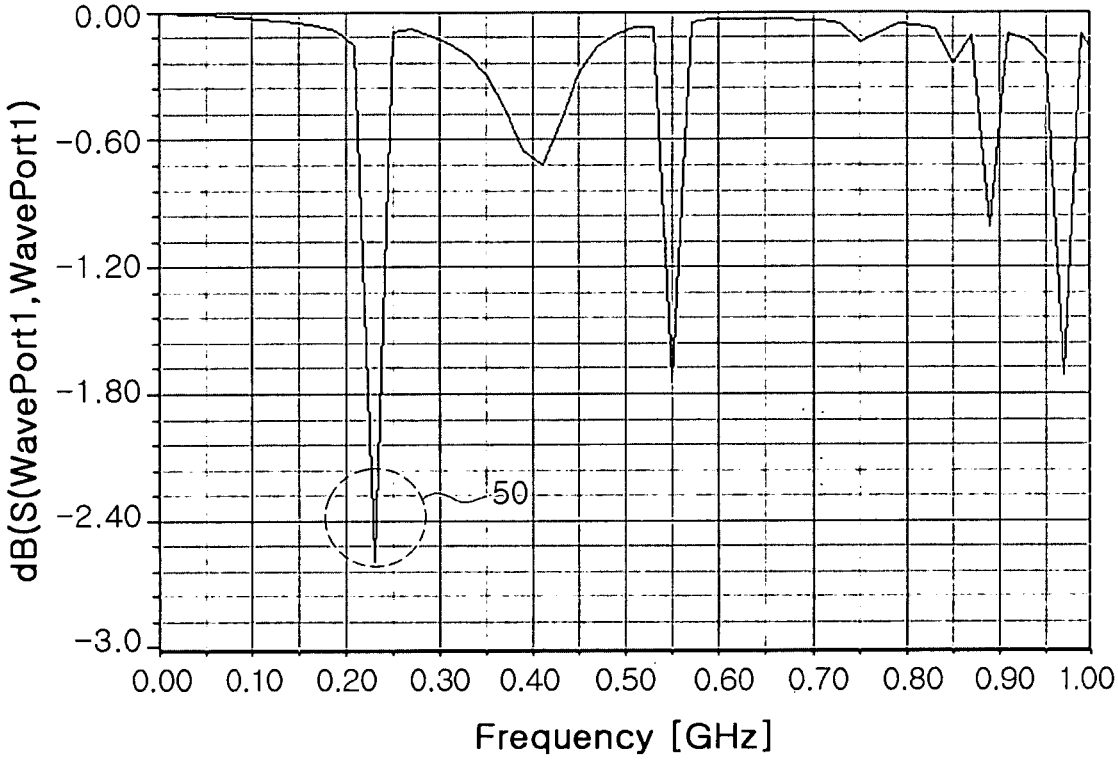
FIG. 5 is a graph illustrating resonant frequency characteristics of a rectangular helical antennal as shown in FIG. 4.

FIG. 5 is a graph illustrating resonant frequency characteristics of a rectangular helical antennal 40 as shown in FIG. 4.

FIG. 5 shows an operation frequency of a helical antenna 40 which used a substrate 41 having dimensions of 20 mm (length L)×3 mm (width W)×1 mm (thickness), and a radiator 44 having a total length of 14.4 cm with 25 turns. In this antenna, lower and upper electrodes 45 and 46 having a width 0.5 mm are spaced from each other by a gap 0.2 mm. Magnetic permeability was 10, and dielectric constant was 10. In the graph, the horizontal axis indicates frequency (GHz), and the vertical axis indicates S11 parameter S (WavePort1, Waveport1) (dB). Referring to FIG. 5, it could be experimentally confirmed that the helical antenna 40 of the invention has a resonance region 50 in vicinity of 230 MHz, with radiation efficiency of 55.60%. In case that the thickness of the substrate 41 is reduced to 0.3 mm (20 mm×3 mm×0.3 mm, 0.018 cc), high radiation efficiency of 42.30% was experimentally observed. In general, since the resonant frequency of an antenna can be adjusted to about several ten MHz after impedance matching, it is understood that the antenna 40 of the invention is available for terrestrial DMB (180 to 210 MHz).

Figure 6:
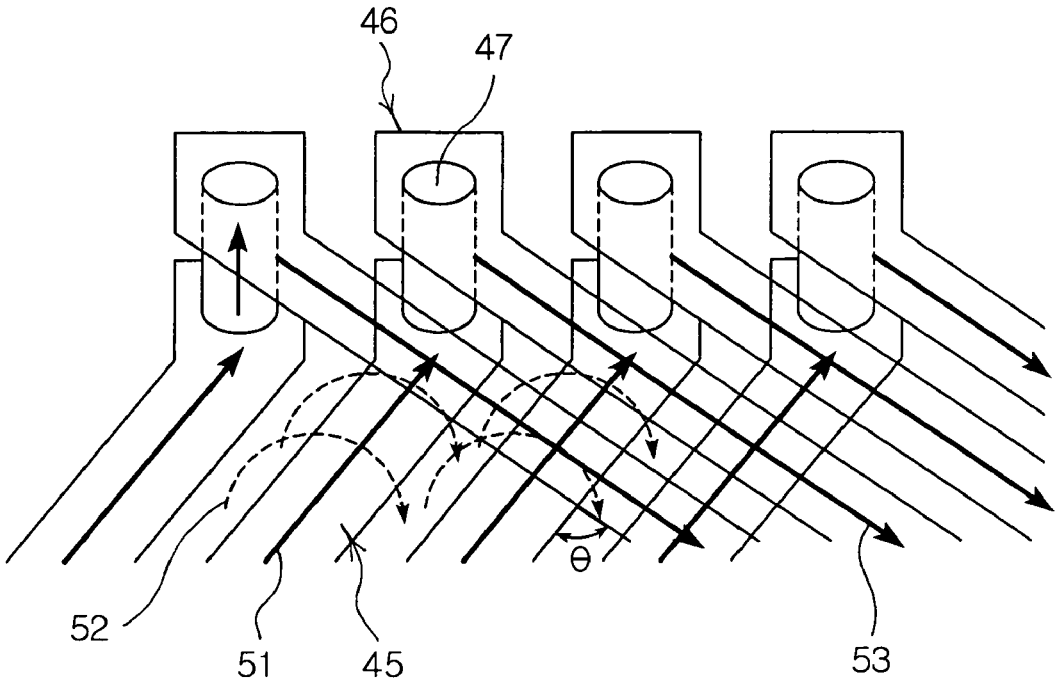
FIG. 6 is a diagram illustrating the direction of current flowing along the rectangular helical antenna and the direction of magnetic fields formed thereby.
Figure 7:
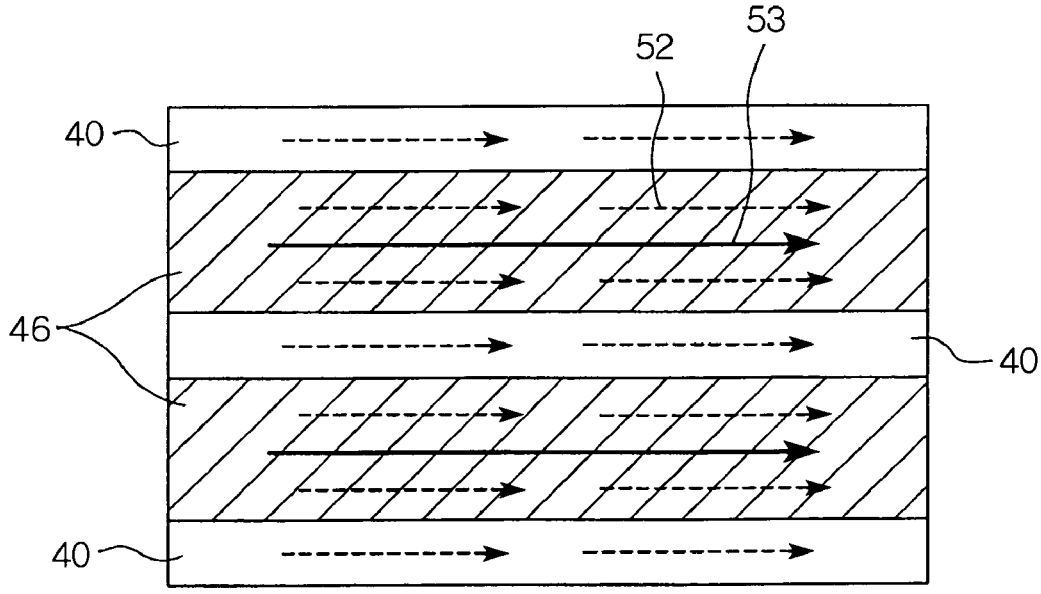
FIG. 7 is a diagram illustrating the direction of current and magnetic fields flowing along an upper electrode in the helical antenna of the invention.

FIGS. 6 and 7 are given to explain the operating principle of the rectangular helical antenna according to the embodiment of the invention.

FIG. 6 is a diagram illustrating the direction of current flowing along the rectangular helical antenna and the direction of magnetic fields formed thereby. Referring to FIG. 6, the rectangular helical antenna of the invention includes a substrate 41 made of magnetic dielectric material, and lower and upper electrodes 45 and 46 formed on the underside and top of the substrate 41. The lower electrodes 45 intersect the upper electrodes 46 or are inclined with respect to the same at a predetermined angle θ, vertically spaced therefrom. The angle θ of each lower electrode 45 with respect to each upper electrode 46 may be set to about 80° to 100°, and preferably, about 90°. With this structure, current 51 flowing along the lower electrode 45 generates a magnetic field 52 around the lower electrode 45.

FIG. 7 is a diagram illustrating the direction of current and magnetic fields flowing along upper electrodes 46 in the helical antenna of the invention. Referring to FIG. 7, a magnetic field 52 formed by current 51 flowing along the lower electrode 45 is directed in parallel with current 53 flowing along the upper electrode 46. Then, the magnetic moment vector corresponding to the magnetic field 52 becomes in parallel with the current 53 flowing along the upper electrode 46. This as a result can enhance an easy-magnetization axis of magnetic material distributed around the upper electrode 46, which is directed in parallel with the current direction of the upper electrode. FIG. 7 shows a situation where the moment vector is directed equal and in parallel with the current 53 flowing along the upper electrode 46. Furthermore, even though the magnetic moment vector and the current 53 flowing along the upper electrode 46 are directed opposite, if they are arranged in parallel, the easy-magnetization axis can be enhanced as above.

If the substrate 41 is made of isotropic magnetic material, the easy-magnetization axis can be equally enhanced. Accordingly, the enhanced easy-magnetization axis increases an effective anisotropy field, thereby extending the resonant frequency of the rectangular helical antenna according to the invention while reducing loss at an equal frequency.

Figure 8:
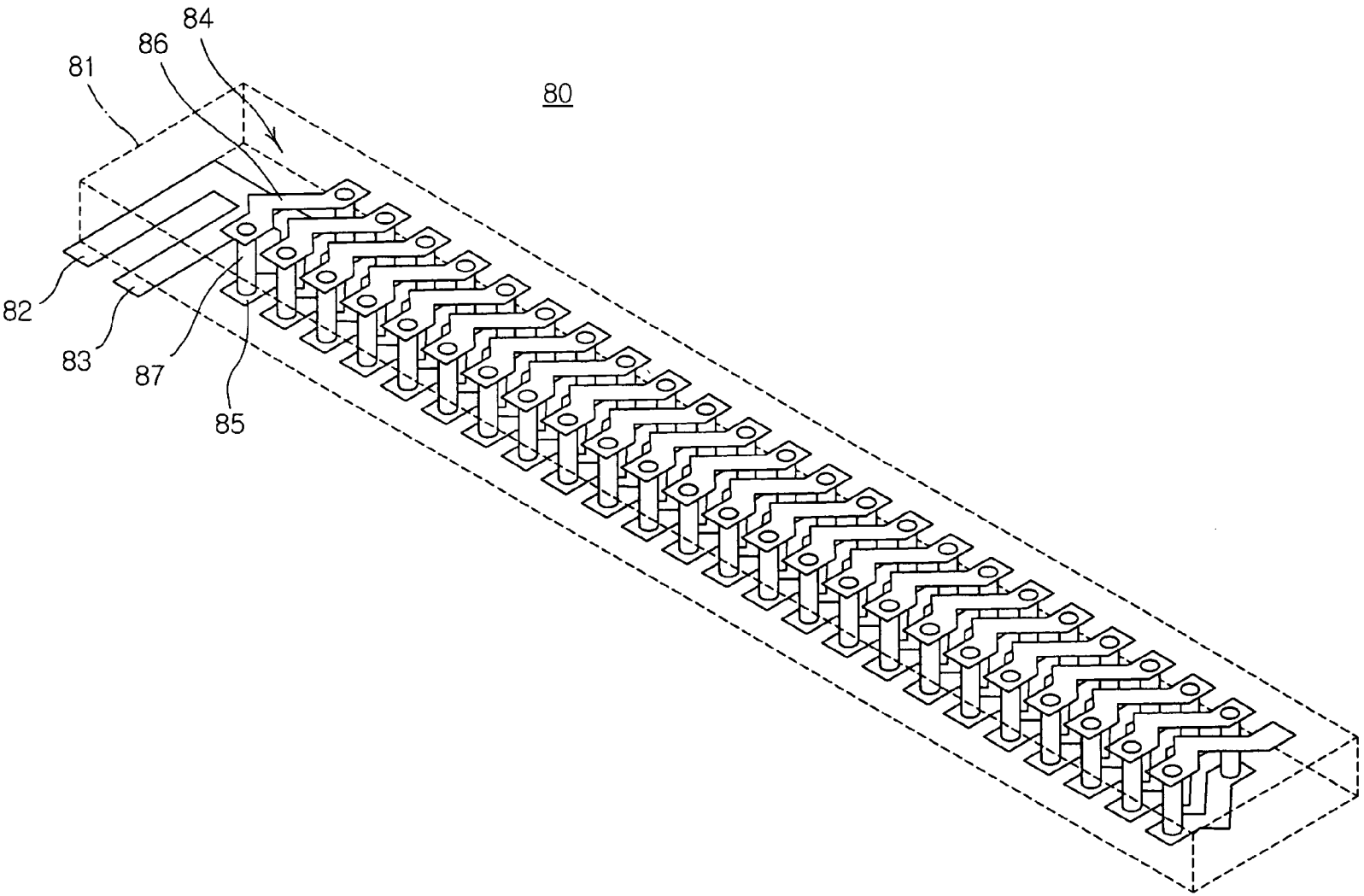
FIGS. 8 and 8*a* are perspective views illustrating a rectangular helical antenna according to another embodiment of the invention.
Figure 8A:
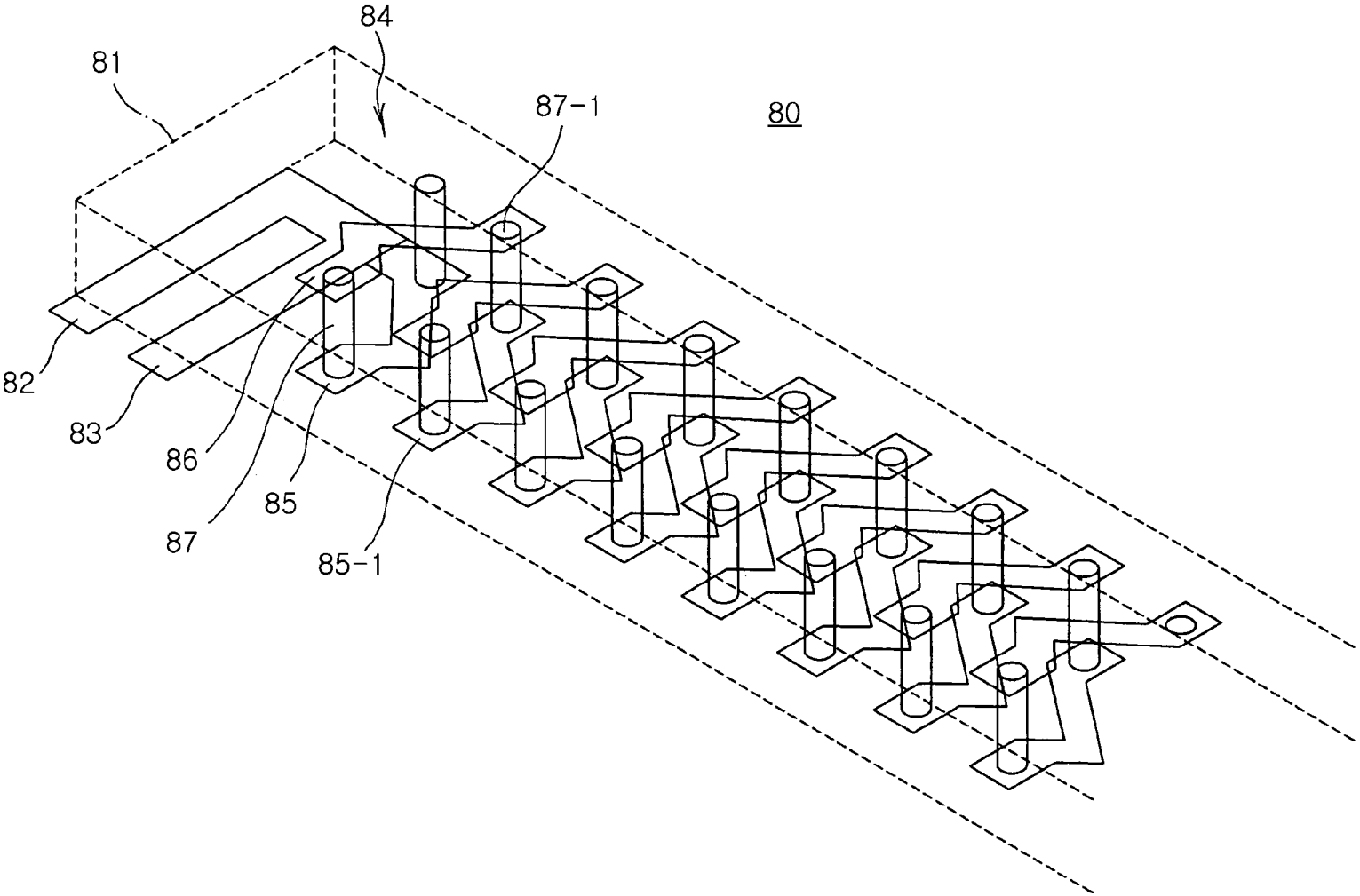

FIGS. 8 and 8*a* are perspective views illustrating a rectangular helical antenna according to another embodiment of the invention.

Referring to FIGS. 8 and 8*b*, a rectangular helical antenna 80 according to another embodiment of the invention includes a substrate 81 made of magnetic dielectric material, a feeding part 82 and a ground part 83 formed on the underside of the substrate 81 adjacent to one end thereof, and a helically-shaped radiator 84. The antenna 80 is distinct from the antenna 40 shown in FIG. 4 in that the upper electrodes 86 are wedge-shaped.

As the upper electrodes 86 of the antenna 80 are wedge-shaped, each upper electrode 86 and a corresponding lower electrode 85 are vertically arranged with each other, intersecting each other or inclined with respect to each other. The upper electrode 86 is connected at the lower end thereof with the lower end of the corresponding lower electrode 85 by means of a corresponding one of side electrodes 87 and the upper electrode 86 is connected at the upper end thereof with the upper end of an adjacent lower electrode 85-1 by means of another side electrode 87-1, thereby producing a helical antenna structure. With the antenna 80 of this structure, a magnetic field formed by current flowing along the lower electrode 45 can influence current flowing along the upper electrode 86 at two portions of the upper electrode 86, thereby further enhancing an easy-magnetization axis. Furthermore, bent portions 88 formed in the upper electrodes 86 are more sharply formed than those of the antenna 4 shown in FIG. 4, thereby enabling easier radiation at the bent portions 88. As a result, this invention can provide means to fabricate a compact built-in antenna while raising radiation efficiency.

Figure 9:
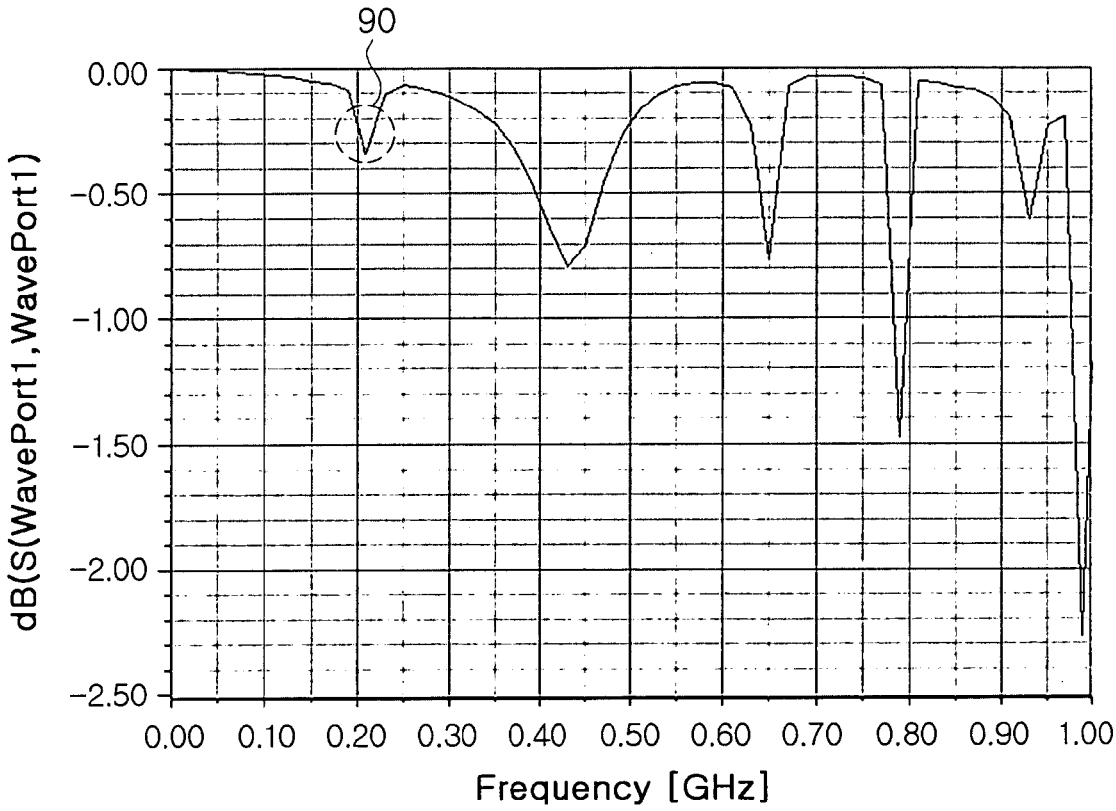
FIG. 9 is a graph illustrating resonant frequency characteristics of a rectangular helical antennal as shown in FIG. 8.

FIG. 9 is a graph illustrating resonant frequency characteristics of a rectangular helical antennal 80 as shown in FIG. 8.

FIG. 9 shows an operation frequency of a helical antenna 40 which used a substrate 81 having dimensions of 20 mm (length L)×3 mm (width W)×1 mm (thickness), and a radiator 84 having a total length of 14.4 cm with 25 turns. In this antenna, lower and upper electrodes 85 and 86 having a width 0.5 mm are spaced from each other by a gap 0.2 mm. Magnetic permeability was 10, and dielectric constant was 10. In the graph, the horizontal axis indicates frequency (GHz), and the vertical axis indicates S11 parameter S (dB). Referring to FIG. 9, it could be experimentally confirmed that the helical antenna 80 of the invention has a resonance region 90 in vicinity of 210 MHz, with radiation efficiency of 34.50%. In general, since the resonant frequency of an antenna can be adjusted to about several ten MHz after impedance matching, it is understood that the antenna 80 of the invention is available for terrestrial DMB (180 to 210 MHz) and thus can be fabricated with a very small size.

As described hereinbefore, the present invention can advantageously provide a small-sized antenna which can be installed in a mobile communication terminal as well as used in a VHF frequency bandwidth for terrestrial DMB and a UHF frequency bandwidth for DVB-H.

Furthermore, according to the present invention, the upper electrodes of the helical antenna together with the lower electrodes form an intersection structure to enhance an easy-magnetization axis, thereby prolong resonant frequency. This as a result can raise radiation efficiency of an antenna while fabricating the antenna in a very small size.

While the present invention has been described with reference to the particular illustrative embodiments and the accompanying drawings, it is not to be limited thereto but will be defined by the appended claims. It is to be appreciated that those skilled in the art can substitute, change or modify the embodiments into various forms without departing from the scope and spirit of the present invention.

What is claimed is:

1. A rectangular helical antenna, comprising:

a substrate made of magnetic dielectric material;

a plurality of lower electrodes disposed on an underside of the substrate;

a plurality of upper electrodes disposed on an upperside of the substrate, wherein the upper electrodes are inclined at a predetermined angle with respect to the lower electrodes, respectively, and each of the upper electrodes has a bent portion in a central area thereof; and a plurality of side electrodes electrically connecting the lower electrodes with the upper electrodes, respectively, whereby at least a part of a magnetic moment vector, which is formed around each of the lower electrodes by a current flowing along said each lower electrode, is directed in parallel with a current flowing along each of the upper electrodes corresponding to said each lower electrode.

2. The rectangular helical antenna according to claim 1, wherein the substrate is made of ferrite.

3. The rectangular helical antenna according to claim 1, wherein the substrate is made of ferrite-resin composite.

4. The rectangular helical antenna according to claim 1, wherein the angle ranges from 80° to 100°.

5. The rectangular helical antenna according to claim 4, wherein the angle is 90°.

6. The rectangular helical antenna according to claim 1, wherein each of the lower and upper electrodes is wedge-shaped.

7. The rectangular helical antenna according to claim 1, wherein each said upper electrode is wedge-shaped, and has at least one area overlapping a corresponding one of the lower electrodes.

8. The rectangular helical antenna according to claim 1, further comprising a feeding part formed on one end portion of the substrate, for feeding current to the lower electrodes.

9. The rectangular helical antenna according to claim 8, further comprising a ground part arranged in parallel with the feeding part and between the feeding part and the lower electrodes, for grounding the antenna.

* * * * *